United States Patent [19]

Fludzinski

[11] 4,448,366

[45] May 15, 1984

[54] COIL DIAMETER TRACKING SYSTEM AND TENSION REGULATION SYSTEM USING SUCH TRACKING SYSTEM

[75] Inventor: Jan M. Fludzinski, Williamsville, N.Y.

[73] Assignee: Westinghouse Electric Corp., Pittsburgh, Pa.

[21] Appl. No.: 396,211

[22] Filed: Jul. 8, 1982

[51] Int. Cl.[3] ..... B65H 77/00; H02P 7/68

[52] U.S. Cl. ..... 242/75.51; 318/7

[58] Field of Search ..... 242/75.51, 75.52, 75.45, 242/56.2, 75.5, 191, 186; 318/6, 7

[56] References Cited

U.S. PATENT DOCUMENTS

| | | | |
|---|---|---|---|
| 3,603,521 | 9/1971 | Ormsby | 242/75.5 X |
| 3,762,663 | 10/1973 | Nedreski | 242/75.51 |
| 3,862,723 | 1/1975 | Bonikowski | 242/75.51 X |
| 3,871,290 | 3/1975 | Verboom | 242/56.2 X |
| 3,871,598 | 3/1975 | Kataoka | 242/75.51 |
| 3,910,521 | 10/1975 | O'Callaghan et al. | 242/75.51 |
| 3,979,080 | 9/1976 | Herbert et al. | 242/75.45 X |
| 4,000,804 | 1/1977 | Zaltieri | 242/75.51 X |
| 4,280,081 | 7/1981 | Dinger et al. | 242/75.51 X |

*Primary Examiner*—John Petrakes
*Assistant Examiner*—Scott J. Haugland
*Attorney, Agent, or Firm*—C. M. Lorin

[57] ABSTRACT

A reel-tension motor drive system embodies circuitry for the instantaneous calculation of the coil diameter of one reel from the instantaneously derived coil diameter of the other reel, thereby requiring the use of only one step velocity signal, the latter preferably on the winding side.

4 Claims, 7 Drawing Figures

COIL DIAMETER TRACKING SYSTEM AND TENSION REGULATION SYSTEM USING SUCH TRACKING SYSTEM

BACKGROUND OF THE INVENTION

The present invention relates to reel-tension motor drive systems in general, and more particularly to such a system for rolling mills, paper manufacturing, etc.

A reel-tension motor drive system generally includes a pay-off reel, a winding reel, one unloading the other in the process, with or without intermediary treatment of the unrolled material, which can be a metal strip passed on a rolling mill, or a paper strip to be processed.

Reel drives involve in general a regulator system in order to maximize the transfer operation of material from one reel to the other without exceeding the permissible tension in the strip in between. This kind of regulation accommodates accelerations and decelerations as can be required with a rolling mill operation, and maintains maximum speed between the extreme conditions from maximum coil diameter to minimum coil diameter in one reel.

Other factors involved are the inertia to be compensated for and the nature of the material which imposes a maximum torque reel and a maximum tension.

A reel-tension system will generally require control circuitry containing references such as run speed, tension, strip velocity, the direction of winding and the coil diameter which is determining inertia compensation on one or the other reel.

One important factor is tracking continuously the coil diameter in order to regulate for the correct tension and provide inertia compensation signals during acceleration or deceleration periods.

It has been the practice until now to use two separate strip velocity signals, one on the entry side, the other on the delivery side of the reel-tension system, and to perform calculations leading to the knowledge of the coil diameters of the pay-off reel and of the rewind reel, respectively.

SUMMARY OF THE INVENTION

The present invention resides in a method of and apparatus for tracking both coil diameters in a reel-tension system involving a pay-off and a rewind reel of strip material.

According to the present invention, a single strip velocity tracking signal is derived and the coil diameters of the respective reels are determined by calculation based on the total mass of strip material being rolled and instantaneously related to the single derived strip velocity tracking signal.

The invention also resides in a regulation and inertia compensation motor drive system for rolling strip material from one reel to another involving said single strip velocity tracking signal and basic calculation.

The invention is applicable to a reversing or a tandem mill for rolling of metal strips, or to a paper mill.

DESCRIPTION OF THE PREFERRED EMBODIMENT

Figure 1:
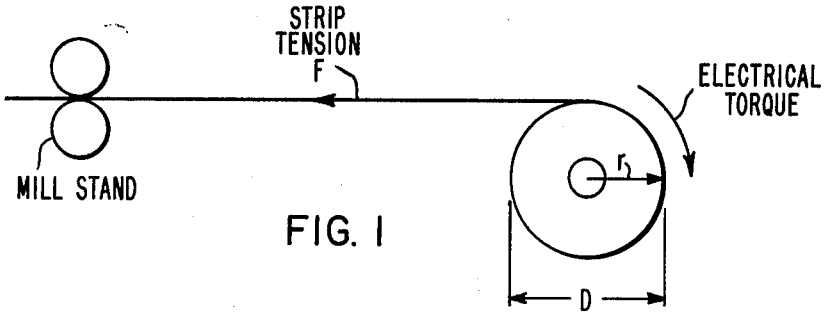
FIG. 1 is illustrative of the parameters of a reel in rotation with a strip of material pulled through a mill stand.

Referring to FIG. 1, a general reel-tension simplified system is shown to illustrate that the mechanical torque exerted by the reel R is made up of two components: the torque due to strip tension=F and the torque required to overcome inertia during acceleration=J dw/dt. The electrical torque due to the motor is bϕi. For energy balance, mechanical torque is equal to electrical torque, i.e., bϕi=F+J dw/dt. This leads to the expression for strip tension:

$$F = b \cdot \frac{\phi}{r} \cdot i - \frac{1}{r} J \frac{dw}{dt}$$

which for steady state conditions reduces to:

$$F = b \cdot \frac{\phi}{r} \cdot i$$

or, expressing in terms of the coil diameter D:

$$F = k_1 \cdot \frac{\phi}{D} \cdot i \qquad (1)$$

It can be seen from equation (1) that to maintain constant strip tension F, two approaches are possible.

A conventional reel drive to regulate for constant armature current (i) requires that the ratio $\phi/D$ be maintained constant. In order to maintain the ratio $\phi/D$ constant, the reel motor field flux $\phi$ is varied in proportion to the coil diameter throughout the coil build-up range, regardless of mill speed. For this reason, a reel drive motor is usually selected with a field range equal to the range of coil build-up.

The coil diameter leads to the following considerations.

Since the motor field flux is made proportional to the coil diameter, the motor is always operated at less than its full torque capability, except for the short time during which the coil diameter is maximum. This means that the acceleration and deceleration of such drives, and hence of the whole mill, are usually limited by the commutating ability of the reel motors at weak field condition, as at minimum coil diameter.

It may not always be economical or practical to select a reel motor that has a field range equal to the coil diameter range. At times, it may be desirable to select a motor field range greater than the amount of coil build-up and, at other times, the field range provided should be less than the coil build-up range. The best choice will depend not only on the design limits and cost of the drive motors, but also on the range of coil build-up.

In addition to requiring the calculation of the diameter D in order to maintain the ratio $\phi/D$ constant, the conventional reel drive also requires the calculation of D for inertia compensation. In this regard, the inertia compensation current is given by: $Ia=\dot{S}(A/D^2+BD^2)$. As will be seen, the second approach to maintain constant strip tension F also requires the calculation of D, both for strip tension control and for inertia compensation. This second approach which will be used, hereinafter, as illustration for the calculation of the diameter in accordance with the present invention, is the one used in the maximum torque type of reel drives. Here, the regulator system for the reel drive, like in a stand regulator, allows the operation of the reel motors at maximum possible flux compatible with a certain speed. In other words, the motor is maintained at full field until base speed and from then on the field is weakened only by the amount necessary to obtain increased motor speed. This allows for a much greater freedom in the choice of the reel drive motor. In addition, operation with maximum flux means operation with the maximum available motor torque at all times, and hence a more efficient utilization of the reel motor.

A continuously variable acceleration (and deceleration) ramp is chosen for the mill that is made a function of the load in any of the main drive machines (stand or reel drives). When such ramp and the maximum torque reel system are incorporated into the mill, the result is an integrated control system that makes it possible to utilize the full capacity of all main drive machines at both steady state and transient (acceleration-deceleration periods) rolling conditions.

Thus, it is clear that, like the conventional reel drive, maximum torque reel regulation also involves knowing the coil diameter. The armature current (i) is made proportional to the coil diameter D and inversely proportional to motor field flux $\phi$:

$$i = k_2 \frac{D}{\phi} \tag{2}$$

the tension, F, in equation (1) can then be written:

$$F = k_1 \cdot \frac{\phi}{D} \cdot k_2 \frac{D}{\phi} = k_1 k_2 = \text{constant}$$

Thus the tension will again be constant and can be set to any desired value by adjusting the proportionality constant, $k_2$. The important point is that the field flux can have any value (limited only by the machine characteristics) and the tension will remain constant as long as the armature current tracks the value of $D/\phi$. The fact that $\phi$ can have any value is used to advantage by making the flux the maximum possible for all conditions. This means that the motor is maintained at full field for all conditions of operation that do not require the reel motor to rotate with a speed greater than base speed. It is even possible that the motor be kept at full field throughout the entire coil build-up, provided only that the mill rolling speed is of a low enough value to allow the reel motor to follow the mill without having to rotate faster than its base speed. This condition will occur for all mill rolling speeds smaller than the product of the reel motor base speed times the minimum coil diameter (mandrel diameter). For mill speeds higher than the above value, the reel motor field will be weakened by the amount necessary to allow for a corresponding higher speed.

In order to obtain the operation of the reel system at maximum flux and with armature current proportional to $D/\phi$, two regulating systems are used: a cemf regulator operating on the motor field and a current regulator operating on the motor armature.

The motor field flux is maintained at its maximum value, $\phi_m$, until the cemf reaches base speed value. Above motor base speed, the cemf regulator regulates for a constant cemf and the field current (hence field flux) is reduced, as necessary, to maintain the cemf constant as the reel motor speed is being increased above base speed.

Thus, we have two zones of operation:

Zone 1, where:

$$n<n_b,\ e<e_m,\ \phi=\phi_m=\text{constant}$$

from equation (2)

$$i = k_2 \frac{D}{\phi} = k_3 D$$

i.e., armature current is regulated proportional to coil diameter, D.

Zone 2, where:

$$n>n_b,\ e>e_m=\text{constant}\ \phi<\phi_m$$

from equation (2)

$$i = k_2 \frac{D}{\phi}$$

$$i = k_2 \frac{Dw}{\phi w} = k_3 S$$

i.e., armature current is regulated proportional to strip speed, S.

Figure 2:
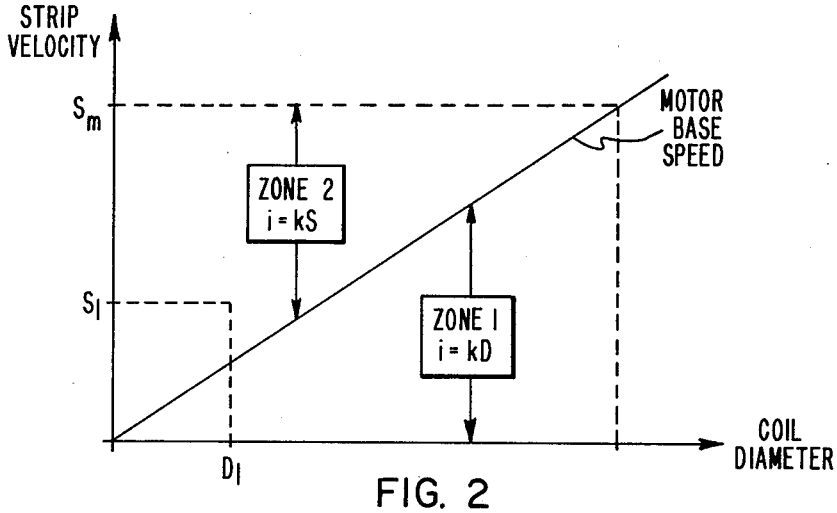
FIG. 2 is a curve showing the base speed line of a motor driving a reel separating a zone of regulation as a function of strip velocity and a zone of regulation as a function of coil diameter build-up.

The two zones of operation are demonstrated graphically in FIG. 2.

It can be seen from FIG. 2 that as long as strip velocity for a given coil diameter is such that the reel motor does not exceed its base speed, the reel current will be regulated in proportion to coil diameter build-up. The field flux is maintained constant at rated value and maximum motor torque is available for tension control.

For cases where strip velocity demands motor speed above its base speed, for instance at strip speed $S_1$ with diameter $D_1$, the motor field flux will be weakened only by the amount necessary to achieve that speed. The reel motor current will now be regulated in proportion to strip velocity.

The above can be expressed in simple mathematical form by transposing equation (1) into expression for current and adding accelerating current, $I_a$, total current, $$i = \frac{1}{k_1\phi} F D + I_a \tag{3}$$

substituting for $I_a$ $$i = \frac{1}{k_1\phi} \cdot F D + \frac{D}{\phi}\left(\frac{A}{D^2} + B D^2\right) \dot{S}$$

multiplying and dividing first term in above equation by "aw" and simplifying, we obtain:

$$i = \frac{a}{b} F\left(\frac{S}{e}\right) + \left(\frac{D}{\phi}\right)\left(\frac{k_1}{D^2} + k_2 D^2\right) \dot{S} \quad (4)$$

where a is the motor cemf constant, b the motor torque constant, w the angular velocity, and e the cmf of the motor. Ignoring for the moment accelerating current requirements, it appears that for a constant tension F in steady state conditions, the current reference signal to be generated varies according to one of the following expressions:

(a) $i = \frac{a}{b} F\left(\frac{S}{e}\right)$ $$i = \frac{a}{b} F \frac{wr}{w\phi} = k D \quad (5)$$

for constant flux ($\phi_m$) below base speed (b) $i = \frac{a}{b} F\left(\frac{S}{e}\right) = k S$ (6)

for constant cemf ($e_m$) above base speed

The above functions can be generated either by means of a servo system or statically.

Figure 3:
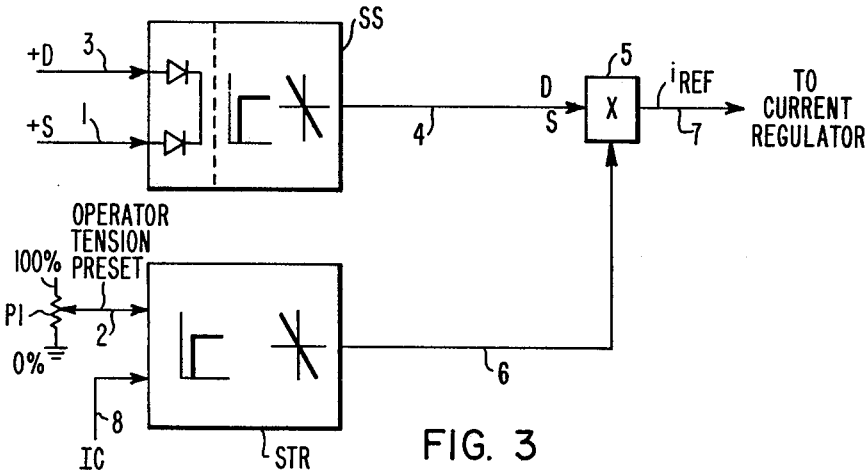
FIG. 3 shows signal selection in accordance with the two zones of FIG. 2 and the associated tension reference setting for current regulation of the motor drive.

Referring to FIG. 3, a static circuit for implementing equations (5) and (6) includes a signal selector SS responsive on line 1 to the strip velocity signal +S, and to the reel diameter signal +D on line 3. Signal selector SS symbolized by two diodes $D_1$ on line 1, $D_3$ on line 3 allowing the larger of the two signals to be passed onto the output line 4. The signal of line 1 corresponds to equation (6) when it exceeds the signal of line 3, controlling the motor for constant cemf ($e_m$) below the base speed, e.g., when the reel is of small diameter and turning above base speed. Conversely, the motor drive is controlled for constant flux ($\phi_m$) when the reel is receiving the strip on a large diameter, rotating below base speed, in accordance with equation (5). In such case it is the signal of line 3 which is passed on line 4.

FIG. 3 also shows on line 2 a tension reference preset by the operator with a rheostat $P_1$ and an inertia compensation signal IC applied on line 8. The signals of lines 2 and 8 are summed by a tension reference summer STR which outputs on line 6 a signal multiplied with the signal from line 4 by a multiplier 5. The output of the multiplier on line 7 is the current reference going to the current regulator.

For the strip tension to remain constant during changes in the mill speed, this extra torque must be anticipated and forced on the reel motor by feeding an extra signal to the current regulator. This signal will sum with the reference, causing the armature current to increase during acceleration of a rewind reel and to decrease during deceleration (for a pay-off reel, the current will decrease during acceleration and will increase during deceleration). It can be shown that the appropriate current signal necessary for acceleration or deceleration is given by the following expression:

$$I_a = \dot{S}\left(\frac{D}{\phi}\right)\left(\frac{A}{D^2} + B D^2\right) \quad (7)$$

where:

$I_a$=armature current necessary for inertia compensation, $\dot{S}$=(ds/dt)=rate of change of strip speed, D=coil diameter, A, B=constants.

It is recalled that, for conventional reel systems, the inertia compensation current is given by:

$$I_a = \dot{S}\left(\frac{A}{D^2} + B D^2\right) \quad (8)$$

The only difference between equations (7) and (8) is the extra term $D/\phi$, appearing in the expression which is automatically taken cae of by equations (5) or (6) as implemented in FIG. 3. The latter applies to a maximum torque reel system. Equation (8) is implemented by the circuitry of FIG. 4.

Figure 4:
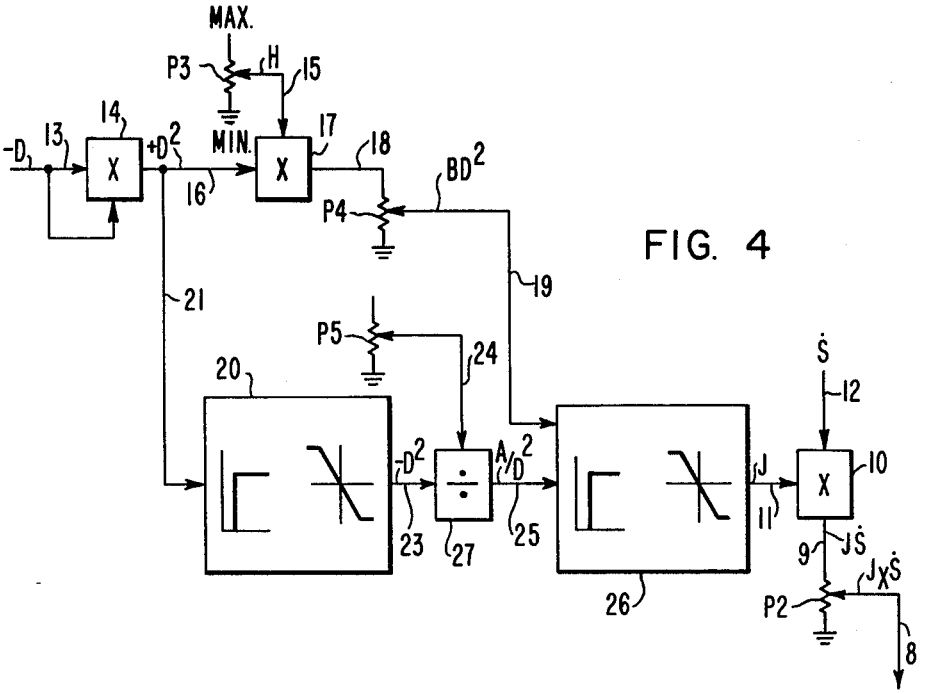
FIG. 4 shows the derivation circuit for the inertia compensation modifying the tension reference setting of FIG. 3.

Referring to FIG. 4 the inertia compensation function of equation (6) is used to generate on line 8 of FIG. 3 a signal IC proportional to the current required for inertia compensation. The signal of line 8 (FIG. 4) is derived from a potentiometer $P_2$ supplied on line 9 with the output (J×S) from multiplier 10 which receives on one side the inertia J (on line 11) and, on the other side the rate of speed S (on line 12) of the strip. In accordance with equation (6), the diameter signal (−D) is applied on line 13 to a multiplier outputting a signal ($+D^2$). The strip width H is derived on line 15 from the setpoint of a potentiometer $P_3$. Signal ($+D^2$) from multiplier 14 is applied with the signal of line 15 to a multiplier 17 to derive the value $BD^2$ on line 19 after potentiometer $P_4$ from line 18 and potentiometer 17. The signal ($+D^2$) is inverted to ($-D^2$) by inverter 20, via line 21. The output ($-D^2$) on line 23 from inverter 20 is applied to a divider 27, and the constant A of equation (6) is obtained from a potentiometer $P_5$ on line 24. The outputted term $A/D^2$ is added to the term $BD^2$ from line 19 by a summer 26, to generate the J signal of line 11. The coil diameter D signal and the strip width H signal are set, typically with a maximum value of 10 volts. Potentiometer $P_4$ and $P_5$ are set so that J=10 volts at the maximum inertia compensation required in the reel system. Potentiometer $P_5$ should be set first at minimum coil diameter for a fixed inertia compensation when $P_4$ is at a zero setting. Potentiometer $P_2$ is then used to properly scale the reference signal IC to the tension reference summer (STR on FIG. 3). For example, if the tension reference summer STR is set at 10 volts for 175% tension, when the inertia compensation signal of line 8 is at 50%, the potentiometer $P_2$ will be set to provide $$J \times \dot{S} = \frac{50}{175} \times 10\text{v} = 2.86\text{v}$$

The tension reference is a signal, the magnitude of which depends upon the tension reference input and the motor field flux. When the motor is above base speed, the motor field is weakened and the current must be raised to maintain constant tension.

The preceding considerations have been with respect to a reel motor drive operating to wind or to unwind a reel such as shown in FIG. 1. A tension reel system in fact uses a pay-off reel PR at the entry and a rewind reel RW at the delivery end of the system. The system may be a rolling mill of the tandem or reversing type. It may also be a paper mill. It appears that knowledge of the coil diameter is necessary in order to control the two reel drives, at the entry and the delivery end, so that tension of the strip be maintained constant. This approach has required tracking two strip speed signals, such as S, and two diameter signals, such as D, in FIGS. 3 and 4.

it is now proposed to measure S and calculate D only at one end of the system, preferably at the delivery end because the strip velocity is more easily ascertained there than at the entry end. The value of D is determined by calculations, and the calculated value D is used to regulate tension and control the second reel drive in lieu of a sensed signal D.

Figure 5:
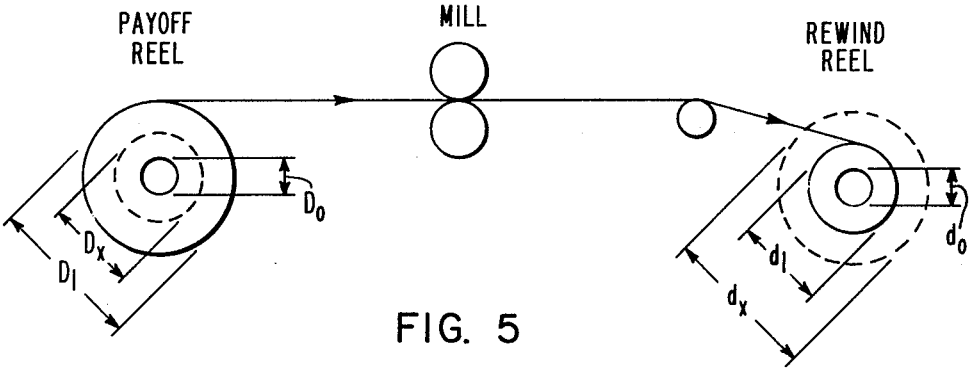
FIG. 5 illustrates the mass distribution between a pay-off and a rewind reel.

When the pay-off reel, at the left on FIG. 5, is full and the rewind reel, at the right, is empty, the total mass M is to the left. Looking from the edge, with a strip of coil width l and of density $\rho$, the mass M on the pay-off reel is $$M_T = \frac{\pi}{4}(D^2 - D_o^2) \times l \times \rho = k(D^2 - D_o^2)$$

if D is the diameter of the pay-off reel full, and $D_o$ the mandrel diameter.

Similarly, when the rewind reel is full and the pay-off reel is empty, the relation is:

$$M_T = \frac{\pi}{4}(d^2 - d_o^2) \times l \times \rho = k(d^2 - d_o^2)$$

where d is the diameter of the rewind reel full, and $d_o$ and mandrel diameter.

Considering the intermediary and temporary situation of FIG. 4, when $D_1$ is the initial pay-off reel diameter, and $d_1$ the initial rewind reel diameter, mass conservation leads to:

$$M_P = k(D_1^2 - D_o^2);\ M_R = k(d_1^2 - d_o^2);\ \text{and}$$

$$M_T = P_p + M_R = k(D_1^2 - D_o^2 + d_1^2 - d_o^2) \quad (9)$$

From such initial position, rolling of the strip of material, or unrolling from one reel to the other, causes the instantaneous or intermediate values $D_X$ on the pay-off reel, $d_X$ on the rewind reel to satisfy the relation:

$$M_{PX} = k(D_X^2 - D_o^2) \text{ for the pay-off reel,}$$

$$M_{RX} = k(d_X^2 - d_o^2) \text{ for the rewind reel,}$$

where $D_X$ is smaller than $D_1$ and $d_X$ is larger than $d_1$. Since $M_T = M_{PX} + M_{RX}$, $$M_T = k(D_X^2 - D_o^2 + d_X^2 - d_o^2) \quad (10)$$

From equations (9) and (10) it follows that:

$$D_1^2 = D_o^2 + d_1^2 - d_o^2 = D_X^2 - D_o^2 + d_X^2 - d_o^2$$

which simplifies to:

$$D_X^2 = D_1^2 + d_1^2 - d_X^2.$$

Therefore:

$$D_X = \sqrt{D_1^2 + d_1^2 - d_X^2} \quad (11)$$

This shows that the calculation of pay-off coil diameter $D_X$ is independent of the entry strip speed and operator draft setting at the pay-off reel side of the system. Conversely, at the delivery side, if the entry strip speed is being accurately tracked, the calculation therefore shows that the instantaneous diameter $d_X$ for the rewind coil can be expressed independently of the delivery speed or of the operator draft setting.

Figures 6, 7:
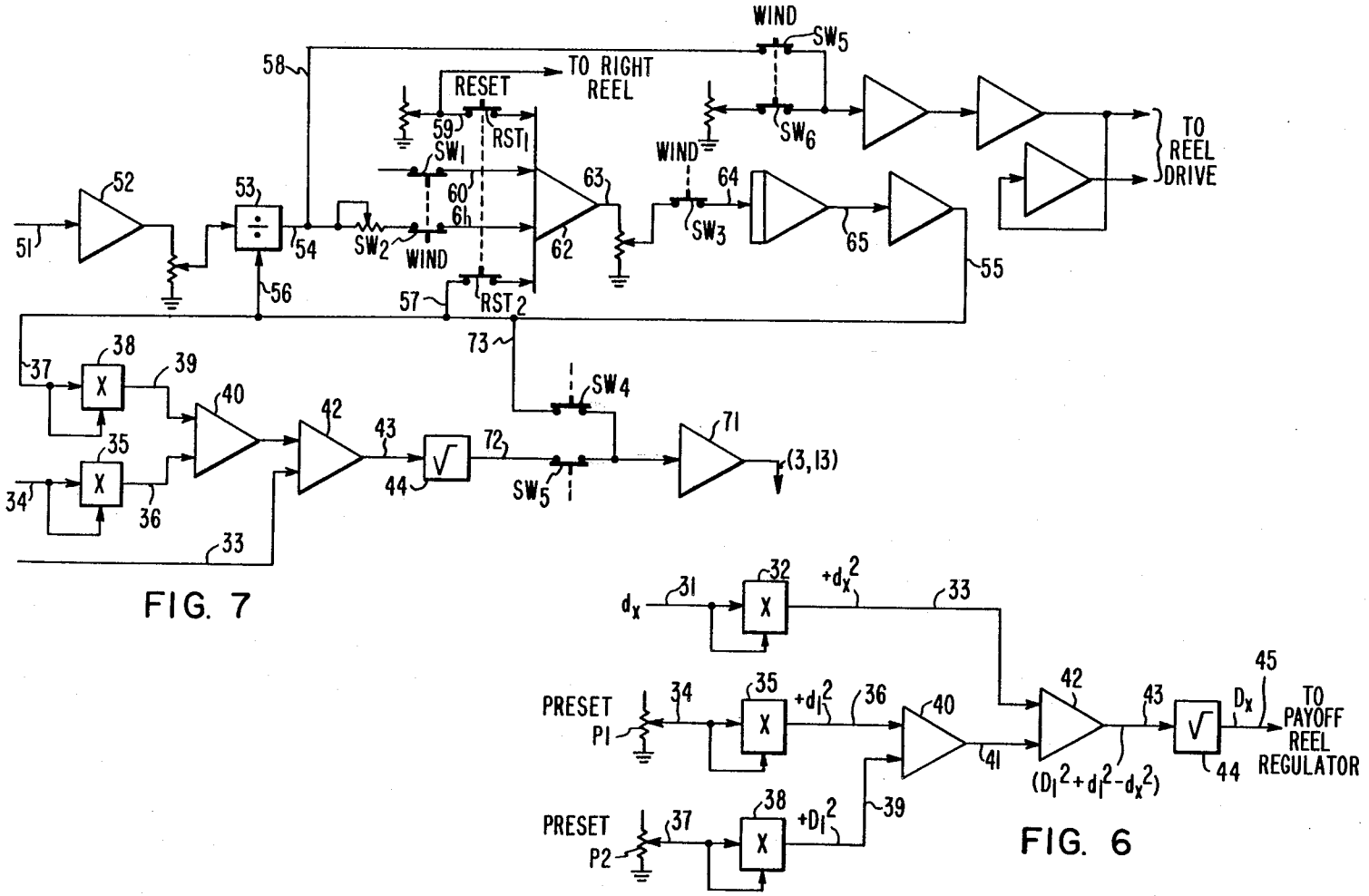
FIG. 6 shows a calculation circuit for the present invention.
FIG. 7 is a preferred embodiment of the invention.

Referring to FIG. 6, a block diagram illustrates how the instantaneous diameter $D_X$ can be generated with conventional hardware.

At the delivery end, the diameter $d_X$ is derived on line 1 in the conventional manner from a combination of strip velocity divided by the diameter of the rewind reel, and the rewind reel motor drive rpm. The signal is squared by the multiplier 32 and the output ($d_X^2$) is outputted on line 33. Potentiometer $P_1$ is preset to provide on line 34 a voltage signal which is the initial diameter $d_1$ of the delivery reel. Similarly, the potentiometer $P_2$ provides on line 37 a preset value $D_1$ of the pay-off reel. Multiplier 35 multiplies by itself the value of $d_1$, and multiplier 38 multiplies by itself the value $D_1$. $d_1^2$ on line 36 and $D_1^2$ on line 39 are added at the input of an inverter 40, so that the sum appearing on line 41 is negative when the signal of line 33 is positive. Summing inverter 42 provides on line 43 the sum of the squared values of equation (11). The squared root function of block 44 converts such sum into the calculated value $D_X$ for the pay-off reel.

According to common practice, the derived instantaneous value $d_X$ at the delivery side is applied to the regulator of the rewind reel drive, while, according to the present invention, the calculated instantaneous value $D_X$ at the entry side is applied to the regulator of the pay-off reel drive.

For the purpose of illustration, the circuit of FIG. 6 is shown in FIG. 7 inserted within a known reel tension reference system, such as already illustrated by FIGS. 3 and 4.

Referring to FIG. 7, the calculation circuit of FIG. 6 is shown associated with the reel reference system of the right (R) reel drive of a reversible rolling mill. The conventionally instantaneous diameter $d_x$ derived during winding of the right reel, e.g., during unwinding of the left reel, is via lines 55 and 31 applied to another calculation circuit like that shown in FIG. 6 for calculating the instantaneous diameter $d_X$ of the left reel coil. The operation of the calculating circuit of FIG. 6 will now be described by reference to the right reel assumed successively to be winding and unwinding, the understanding being that symmetrical operation exists with the left reel occurring on the unwinding and winding phases in the alternative.

For the right reel, on line 51 is derived a signal representing in volts the strip velocity coming out from the mill for winding operation (but not used for unwind mill switches $SW_2$, $SW_3$, $SW_5$, $SW_6$ are open for unwind operation), the difference being the opposite sign on line 51. Inverter 52 provides the opposite sign of the signal of line 51 and it is applied to a divider 53 which receives from line 56 the feedback value of the diameter $d_x$ (for winding), thus, applying on output line 54 a signal $s/d_x$.

The velocity divided by the diameter is equivalent to a speed of operation. It is compared with an rpm feedback signal derived on line 60, and both signals, the one of line 54 and the one of line 60, are applied through a closed switch $SW_1$ for line 60, $SW_2$ for line 54 (when the reel is winding) to a comparator 62 deriving on line 63 an error signal which is passed via a switch $SW_3$ (closed when the reel is winding) onto an integrator INT. For each detected error on line 63, an increment is stored by the integrator and accumulated to form a value on line 65 which represents the new value of the diameter. As the diameter $d_x$ of line 65, and line 55 increases, the signal is fed back to the divider 53 so that S/d of line 54 decreases to nullify the error. However, the increased diameter on the reel causes the rpm to decrease further and a new incremented value of $d_x$ to be fed back to divider 53 assisting the signal of line 53 in catching up with the rpm signal of line 60.

Calibration is effected when initiating the coding process. To this effect, switches $RST_1$ and $RST_2$ are closed on resetting. The initial coil diameter $D_1$ is passed by $RST_1$ onto comparator 62 and the feedback value by lines 55 and 57 prints a calibration of the reset integrator INT to an initial value. Then, the actual process by lines 60, 61 is started with resetting switches $RST_1$, $RST_2$ open again. Then, on line 55 a signal $d_x$ is derived representing the instantaneous value of the diameter as the right reel is being wound up from an initial value $d_1$. When the coil has been formed totally from the pay-off, or left, reel (not shown) a certain final diameter is reached which represents now the initial diameter $D_1$ when the right reel becomes the pay-off reel and the left reel (not shown) becomes the winding or delivery reel, in the reversible rolling mill of FIG. 7. Accordingly, when the winding operation just described has been terminated, upon reversal, the integrator is cut off from line 63 by switch $SW_3$ (now open) and integrator INT retains the value $D_1$ accumulated on the right reel. The same process takes place now with the left reel deriving a diameter $d_X$ from a line similar to line 55 (not shown) whereas the line 55 (of FIG. 7) goes to the calculation circuit of the left reel (not shown).

It appears now that with the calculation circuit of FIG. 6 inserted as shown in FIG. 7, line 55 provides the diameter $D_1$ on line 37 into the multiplier 38, namely the initial diameter after winding of the right reel up to $D_1$ which is to be squared according to equation (11). From the left reel and its associated integrator INT (not shown) is derived the initial value $d_1$ and the squared value $d_X^2$ obtained from the other reel calculation circuit. Therefore, on line 3 of the calculation circuit of FIG. 6, as seen in FIG. 7, is derived $D_X$ which is applied by line 3 to effect the inertia compensation as shown by FIG. 4 and the tension reference as shown by FIG. 3.

Although two calculation circuits like shown in FIG. 6 are assumed to exist, one for the right reel (as shown in FIG. 7) and one for the left reel, it is to be understood that a single calculation circuit can be used, provided switches are provided in order that upon winding of the right reel, line 3 derives $d_X$ while line 33 receives $D_X^2$, and conversely, upon winding of the left reel, line 3 calculates $d_X$ while line 33 receives $d_X^2$.

It is observed that while the calculation circuit of FIG. 6 requires only measuring S/D and rpm signals on the winding side, the uncertainty of such measurements on the unwinding side are avoided, and therefore tension control and reel speed regulation during strip processing are improved. The invention has been described in the context of a reversible mill. It is applicable to the simpler situation where one reel is always winding and the other only a pay-off reel.

It should be noted that if rewinding is always started with an empty mandrel of diameter $d_o$, there is no operator preset required. It will be sufficient to provide a constant signal in place of $d_1^2$. This usually will be the case on a cold rolling mill.

The invention is applicable to passing a strip through a coil mill's edge trimmer, as used generally on the last pass of a rolling mill in order to eliminate the cracked edge problem. Since the edge trimmer removes material from the strip, the mass loss must be taken into account by the formula:

$$k(H-h)(d_X^2-d_1^2)$$

where H is the untrimmed coil width, e.g., on the pay-off reel, and h the width after trimming on the rewind reel. Initial Conditions:

$$M_P=k(D_1^2-D_o^2)H$$

$$M_R=k(d_1^2-d_o^2)h$$

$$M_T=k[H(D_1^2-D_o^2)+h(d_1^2-d_o^2)]$$

After some rolling, the mass loss due to trimming is:

$$k(H-h)(d_X^2-d_1^2).$$

Since the pay-off mass is $$M_{px}=kH(D_X^2-D_o^2),$$

and the rewind mass is $$M_{RX}=kh(d_X^2-d_o^2),$$

the total mass will be $$M_{TX}=k[H(D_X^2-D_o^2)+h(d_X^2-d_o^2)].$$

However, $$M_{TX}=M_T-k(H-h)(d_X^2-d_o^2),$$

Then:

$$k[H(D_X^2-D_o^2)+h(d_X^2-d_o^2)]=$$
$$k[H(D_1^2-D_o^2)+h(d_1^2-d_o^2)-(H-h)(d_X^2-d_1^2)].$$

Solving for $D_X$, it follows that:

$$D_X=\sqrt{D_1^2+d_1^2-d_X^2}$$

which is of the same relation as without trimming.

It appears, therefore, that no special treatment is necessary when an edge trimmer is interposed between the pay-off reel and the rewind reel.

It is also understood that while the invention has been described in the context of analog circuitry for the calculation of the diameter $D_X$, or $d_X$, this calculation can be performed by a microprocessor whenever the signals available for such calculation are digital in form, namely, when reel tension control, inertia compensation and diameter derivation are performed with a computer-based installation.

I claim:

1. Apparatus for rolling material from a pay-off reel driven by a first motor drive to a rewind reel driven by a second motor drive, comprising:

means for measuring the instantaneous diameter $d_X$ of one of said reels and for deriving a first signal representative of $d_X$ during the rolling operation;

means for calculating the instantaneous diameter $D_X$ of the other of said reels in accordance with the formula:

$$D_X = \sqrt{D_1^2 + d_1^2 - d_X^2}$$

where $D_1$ is the initial diameter of one of said reels and $d_1$ is the initial diameter of the other of said reels and for deriving a second signal representative of $D_X$;

first means responsive to said first signal for controlling the motor drive associated with said one reel in relation to the ratio $\phi_1/d_X$, where $\phi_1$ is the flux of the motor drive associated with said one reel;

second means responsive to said second signal for controlling the motor drive associated with said other reel in relation to the ratio $\phi_2/D_X$, where $\phi_2$ is the flux of the motor drive associated with said other reel;

said first and second control means being controlled independently to provide desired tensions upon said pay-off and rewind reels, respectively.

2. The apparatus of claim 1 with said measuring means being operative in relation to the rewind reel.

3. The apparatus of claim 1 with said pay-off reel and said rewind reel exchanging their pay-off and rewind functions alternately as part of a reversible installation; switching means being provided associated with said calculating means for reversing the calculation of one of $D_X$ and $d_X$ and transferring the operation of said measuring means to operation in relation to the other of $D_X$ and $d_X$ and in accordance with said formula.

4. The apparatus of claim 1 with a second calculating means being provided in relation to said one of said reels for calculating the diameter $d_X$ thereof in accordance with the formula:

$$d_X = \sqrt{D_1^2 + d_1^2 - D_X^2},$$

and a second means being provided for measuring the instantaneous diameter $D_X$ of said other of said reels;

said diameter $d_X$ being calculated for said one reel when it is the pay-off reel, and said diameter $D_X$ being calculated for said other reel when it is the pay-off reel.

* * * * *